US006992594B2

(12) United States Patent
Dudley

(10) Patent No.: US 6,992,594 B2
(45) Date of Patent: Jan. 31, 2006

(54) PIPELINE MONITORING SYSTEM

(76) Inventor: Douglas Dudley, 5735 Hobnail Cir., West Bloomfield, MI (US) 48322-1634

( * ) Notice: Subject to any disclaimer, the term of this patent is extended or adjusted under 35 U.S.C. 154(b) by 532 days.

(21) Appl. No.: 10/151,399

(22) Filed: May 20, 2002

(65) Prior Publication Data

US 2002/0171438 A1 Nov. 21, 2002

Related U.S. Application Data

(60) Provisional application No. 60/292,211, filed on May 18, 2001.

(51) Int. Cl.
*G08C 17/02* (2006.01)

(52) U.S. Cl. ..... 340/870.07; 324/71.1; 205/777.5; 340/870.16

(58) Field of Classification Search ..... 340/870.16, 340/870.07; 324/72, 637, 71.1
See application file for complete search history.

(56) References Cited

U.S. PATENT DOCUMENTS

| | | | |
|---|---|---|---|
| 3,860,912 | A | 1/1975 | Romans |
| 4,031,513 | A | 6/1977 | Simciak |
| 4,090,170 | A | 5/1978 | Lincklaen-Arriens et al. |
| 4,136,309 | A | 1/1979 | Galberth et al. |
| 4,573,115 | A | 2/1986 | Halgrimson |
| 5,306,414 | A | 4/1994 | Glass et al. |
| 5,437,773 | A | 8/1995 | Glass et al. |
| 5,469,048 | A | 11/1995 | Donohue |
| 5,539,396 | A | 7/1996 | Mori et al. |
| 5,614,893 | A | 3/1997 | Ahmad et al. |
| 5,659,303 | A | 8/1997 | Adair, Jr. |
| 5,689,233 | A | 11/1997 | Kurisu et al. |
| 5,689,248 | A | 11/1997 | Esfahani et al. |
| 5,784,004 | A | 7/1998 | Esfahani et al. |
| 5,785,842 | A | 7/1998 | Speck |
| 5,859,873 | A | 1/1999 | Ritter |
| 5,942,991 | A | 8/1999 | Gaudreau et al. |
| 5,959,550 | A | 9/1999 | Giles |
| 5,999,107 | A | 12/1999 | Cooper et al. |

*Primary Examiner*—Michael Horabik
*Assistant Examiner*—Hung Dang
(74) *Attorney, Agent, or Firm*—Brinks Hofer Gilson & Lione

(57) ABSTRACT

Disclosed is a Test Point Monitor (TPM) remotely coupled to a Test Point Interrogator (TPI) for the purpose of measuring and communicating cathodic protection voltage values from an object of interest, generally an underground pipeline. The TPM automatically measures cathodic voltage records them in its memory. A technician is guided towards the TPM by a handheld TPI. The TPI includes a GPS function, and when the technician is in range of the TPM, the TPI will call for the stored TPM data. The TPM is adapted for storing in its memory past voltage readings, and transmitting current and past voltage readings to the TPI. The TPI will store data from several thousand such TPM units for download into a main database via direct connection to the database, via wireless transmission, or via the internet.

29 Claims, 3 Drawing Sheets

PIPELINE MONITORING SYSTEM

CROSS-REFERENCE TO RELATED APPLICATIONS

This application claims the benefit of U.S. Provisional Application No. 60/292,211 filed on May 18, 2001.

BACKGROUND OF THE INVENTION

The present invention is related to an improvement to the process of monitoring the protective voltage placed on buried steel pipelines subject to corrosion. Natural gas pipelines are of that type. At present, a sacrificial electrode (anode) is connected to gas pipelines at selected locations along their length. The sacrificial electrode prevents galvanic action from corroding the pipeline. It is necessary to periodically evaluate the integrity of the sacrificial anode electrode. This is done through an electrical lead connected to the pipeline (cathode). An electrical potential is generated between pipeline and a ground reference cell. A potential difference above a certain threshold, i.e. negative 0.85 volts, indicates an operable cathode. Impressed DC current from a fixed AC rectifier can also supply the cathodic protection voltage.

BRIEF SUMMARY OF THE INVENTION

Corrosion of buried pipelines including gas pipelines is abated by inducing a low power current in the pipeline through a buried anode. A properly protected pipeline will show a voltage of approximately −1 V. In one common configuration, it is measured through a process which requires a field technician to locate the test point, uncover it, attach a voltmeter to the test line, record the reading, disconnect and replace the cover. The corrosion status is monitored in this manner one or two times per year. These test points are often hard to find and require metal detectors and shovels to locate and expose. Other test points are difficult to access. For example, if a test point is located on a busy street, any testing will require traffic stoppage permits and testing may be limited to Sundays in the early hours. Some test points are above ground but in areas so remote as to be accessible only by all terrain vehicles or by air.

The successful reading and recording of the buried pipeline corrosion status is mandated by federal law and essential to the safe transmission of gas through buried metal pipelines. Due to the difficulties resulting from the location and reading of these test points, it is desirable to provide a system that allows for remote and efficient testing of the integrity of a pipeline.

Accordingly, the system of the present invention uses a radio frequency identification (RFID) type tag transponder. The device is installed in a protective housing near the cathode connection test point. The device has an internal lithium battery and remains in a sleeping state until it awakens with an internal timer and takes reads on a preset schedule. On interrogation by a wake-up radio frequency from a hand-held computer, the device broadcasts a signal with an encoded voltage reading, preferably on a 900 MHz wide spectrum band. This system would enable a vehicle to drive by a location and send out interrogation signals for nearby transponders. These transponders would in turn produce signals providing cathode protection voltage levels. The process can be executed entirely from a vehicle driving by the test site. This approach would be safer, save labor in a significant way, and would further provide a means for documenting readings.

The data gathered by the interrogation hand-held computer is uploaded to a central database using cell phone connection, via the internet, or via direct connection to the database computer. Data is then analyzed and out of tolerance readings transmitted to the operator via email or other suitable means. Similarly, once repairs are made, confirmation readings showing the appropriate protective charge could be quickly gathered. The database storage of out-of-tolerance and repaired test point voltages, in combination with the multiple readings per test point, creates a system more easily and thoroughly monitored by the pipeline system operator and regulatory agencies resulting in greater integrity to the pipeline system.

DETAILED DESCRIPTION OF THE INVENTION

The invention described herein combines GPS (global positioning system) technology, RF (radio frequency) narrow band and Spread Spectrum communications, and extremely low power use components in a new system which would accomplish the automatic reading of the test points.

The system includes a Test Point Monitor (TPM), designated by reference number 10 in FIG. 1, installed above or below ground in a test point housing (not shown). The TPM 10 will automatically turn itself on and take voltage readings at scheduled intervals, for example every month, and record them in its memory. A technician receives the voltage readings at a location remote from the TPM 10 location. The technician is guided towards the TPM 10 by a handheld Test Point Interrogator (TPI), shown in FIG. 2 and designated by reference number 50. The TPI 50 includes a GPS function discussed further herein, and when the technician is in range of the TPM 10, the TPI 50 will call for the stored TPM data. The TPM 10 is adapted for storing in its memory past voltage readings, and transmitting current and past voltage readings to the TPI 50. The TPI 50 will store data from several thousand such TPM 10 units for download into a main database via direct connection or via the internet.

Figure 1:
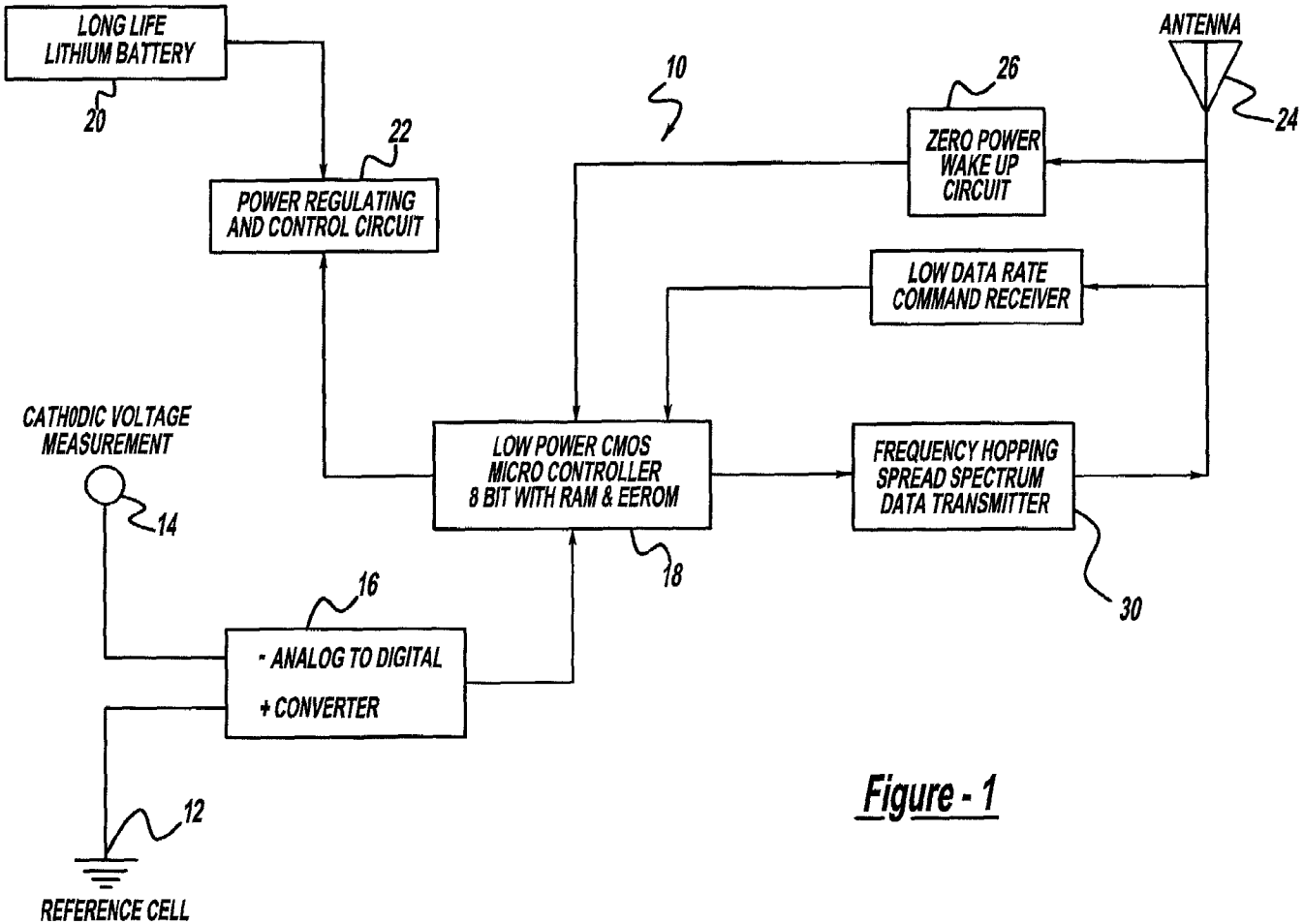
FIG. 1 is a functional block diagram of the components of the cathodic voltage test point monitor in accordance with this invention.

Details of the TPM 10 are shown in FIG. 1. As shown, the TPM 10 is coupled to a reference cell 12. A potential difference between a cathodic voltage measurement point 14 and the reference cell 12 is measured at an A to D converter 16 which produces a digital output signal inputted into a CMOS microcontroller 18. The microcontroller 18 receives power from a battery 20 and a power regulator 22. An antenna 24 receives a "wake-up" signal which activates the microcontroller 18 through a wake-up circuit 26. The interrogation signal would be initially processed by a command receiver 28. Once activated to output its encoded voltage signal, the microcontroller 18 transmits the signal via a data transmitter 30 to antenna 24 for broadcast and receipt by the TPI 50.

Figure 2:
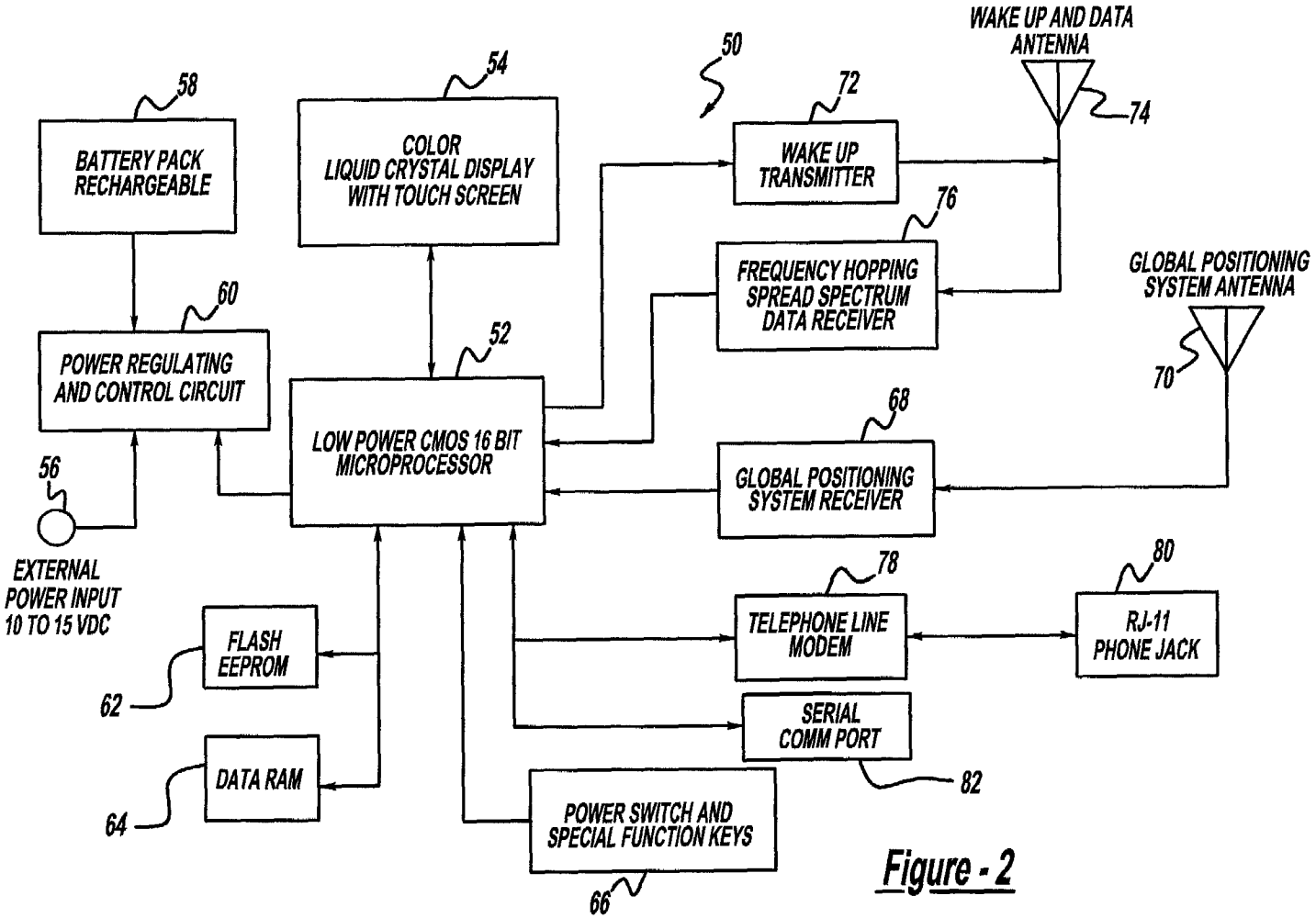
FIG. 2 is a functional block diagram of the test point interrogator of the system in accordance with this invention.

FIG. 2 illustrates the Test Point Interrogator (TPI) 50. The TPI 50 includes a microprocessor 52 which displays information via an LCD display 54. The LCD display 54 also includes an input/output function operable through a touch screen display. A power switch and special function keys 66 provide an additional input function in conjunction with a touch screen display 54.

The microcontroller 52 is powered either by an external power input 56 or a rechargeable battery pack 58, both which are regulated through a power regulating and control circuit 60. Memory for data and operating system software is retained on flash EEPROM memory 62 and RAM memory 64. A GPS receiver 68 receives GPS positioning signals via a GPS antenna 70 that provides location fixing information and status information concerning the TPM 10 to the microcontroller 52. In this manner, the system can identify test points in the immediate locality of the TPI 50.

The identification tags for each of the test points being interrogated can also be stored within the EEPROM memory 62 and the RAM memory 64. A wake-up signal is sent via a wake-up transmitter 72 and the antenna 74 to the TPM 10. The antenna 74 also receives encoded cathode voltage readings from TPM 10 through a data receiver 76. Transmission of data stored within the TPI 50 to a central control center (not shown) may take place via telephone line modem 78 connected with phone jack 80, or by wireless transmission using a cell phone (not shown). Alternatively, the TPI 50 may be coupled directly or indirectly to the central control center via a corn port 82.

The TPI 50 also includes the ability to monitor a TPI rechargeable battery 62 reserve level for uninterrupted service. A vehicle mount (not shown) will be used to provide TPI 50 power and remote antenna features for improved sensitivity. On removal from the vehicle mount there will be a transmission power reduction and a manual call signal trigger activated in the TPI 50 to protect the operator. The GPS 68 mapping features of the TPI 50 provide both visual and audio signals to a user indicating test point locations. Additionally, the TPI 50 is configured such that if the GPS 68 system locates a proximal TPM 10, the GPS 68 cooperates with the TPI 50 to automatically interrogate the proximal TPM 10 and thus automate the process of reading the cathodic voltage measured by the TPM 10.

The life of the TPM 10 is extended by scheduling the interrogation signal listening mode for a predetermined time interval. Moreover, the life of the TPM is extended by enabling the TPI 50 to store the read history and thereby not unnecessarily interrogate a TPM 10 which has already been read within the established time interval. In an alternative embodiment, the TPM may have a replaceable battery for extended life.

The TPM 10 may also interrupt measurements to estimate the polarized potential. This is accomplished by a TPM function that breaks the circuit between two of its lead wires and within one second, takes an off-voltage reading. The TPM 10 also allows for this interrupt feature to work with a coupon that is protected in the normal operating state and disconnected from the protective DC circuit for measurement. This interrupt or instant-off measurement can also be accomplished for structures protected by impressed current by using the GPS receiver 60 of the TPI 50 as a highly accurate timing piece. By synchronizing the TPI 50 with an impressed current interrupter, more than one TPM 10 used on that structure can be interrogated at precisely the correct time to give an "on" potential reading followed by an "off" potential reading.

In a preferred embodiment, the present invention is adapted to analyze the voltage readings and, if a critical problem exists, the TPM 10 initiates a emergency beacon or other suitable signal without being activated by the interrogation signal.

Figure 3:
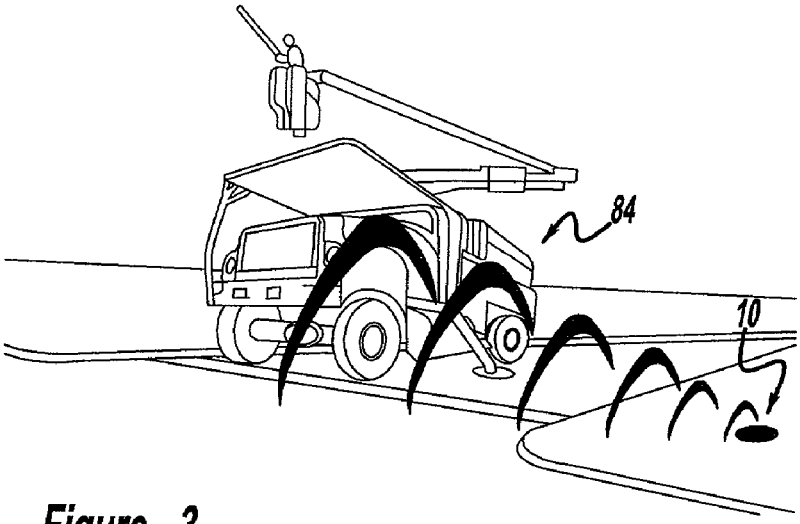
FIG. 3 is a pictorial view illustrating a manner of interrogating a cathodic voltage test point monitor.

FIG. 3 illustrates a truck 84 that may drive in the proximity of a nearby test point monitor 10 to interrogate that test point.

Figure 4:
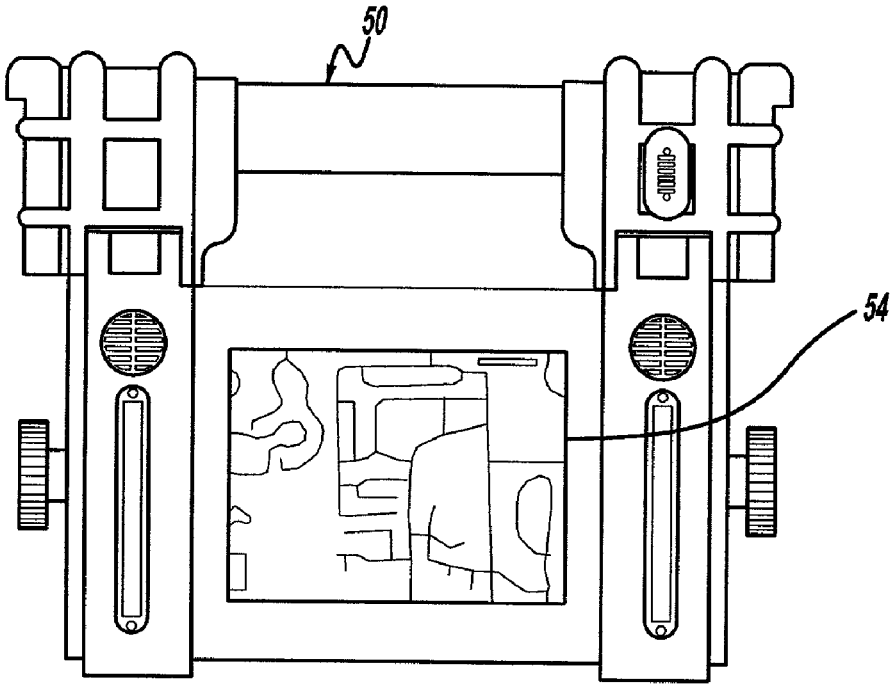
FIG. 4 is an enlarged view of the hand held unit also shown in FIG. 3.

FIG. 4 illustrates a preferred TPI unit 50. This illustration shows the display 54, which is depicted as displaying a map that is used for locating a nearby TPM 10.

The present invention provides the following benefits over the existing method. First, the frequency of voltage readings would be greatly increased so that a more thorough history is established. Secondly, the ease and speed of locating the test points using GPS and RF communications, especially in rural settings, would greatly reduce the man-hour requirements of testing and compliance. Thirdly, the ability to remotely receive data from units located in high traffic areas would reduce or eliminate the traffic problems associated with the current methodology. Fourthly, the TPI 50 will allow direct voltage readings from a test point where no TPM 10 is utilized. This type of reading is verified by ensuring that the GPS location of the TPI matches the database position for the test point being tested. Lastly, the database of precise GPS positions for each TPM 10 will allow for more rapid responses to pipeline emergencies.

In alternative embodiments, the TPM 10 and TPI 50 of the present invention may be utilized to measure the cathodic voltages of other buried assets, as well as in difficult to access areas such as storage tanks or silos. For example, with a reconfigured antenna, the TPM 10 could be placed at an above ground test point for enabling data transmission to a TPI 50 located in an airplane or helicopter.

Although this invention has been described in connection with pipelines for supplying natural gas, the concepts herein are equally applicable in other environments. For example, pipelines that transmit oil, petroleum, or water and that are made from steel or structural steel assets protected by cathodic voltage are also candidates for this invention. Numerous other applications will likely be available. It should be apparent to those skilled in the art that the above-described embodiment is merely illustrative of but a few of the many possible specific embodiments of the present invention. Numerous and various other arrangements can be readily devised by those skilled in the art without departing from the spirit and scope of the invention as defined in the following claims.

I claim:

1. A cathodic protection measurement system comprising:

a test point monitor including a first antenna sending and receiving wireless signals; said test point monitor operating in a sleep state and an active state, wherein said active state includes selectively measuring a cathodic voltage value; and a test point interrogator having a second antenna sending and receiving wireless signals; said test point interrogator wirelessly coupled to said test point monitor, said test point interrogator adapted for sending an interrogation signal to said test point monitor and receiving an output signal from said test point monitor indicative of said cathodic voltage value;

wherein said test point interrogator includes a global positioning system (GPS) and a display, and wherein said GPS communicates a position and a status of said test point interrogator to said display such that said position of said test point interrogator is displayed.

2. The cathodic protection measurement system of claim 1 wherein said test point monitor includes memory circuitry for recording a first plurality of cathodic voltage values.

3. The cathodic protection measurement system of claim 2 wherein said first plurality of cathodic voltage values includes cathodic voltage values measured at a predetermined time interval.

4. The cathodic protection measurement system of claim 1 wherein said test point monitor includes one of a long life lithium battery or a replaceable battery.

5. The cathodic protection measurement system of claim 1 wherein said GPS communicates said position and said status of said test point interrogator audibly.

6. The cathodic protection measurement system of claim 1 wherein said GPS locates a proximal test point monitor, and further wherein said GPS cooperates with said test point interrogator such that said test point interrogator automatically sends said interrogation signal to said proximal test point monitor.

7. The cathodic protection measurement system of claim 1 wherein said test point interrogator includes a modem transmitting said cathodic voltage value.

8. The cathodic protection measurement system of claim 1 wherein said test point interrogator includes a serial communication port transmitting said cathodic voltage values.

9. The cathodic protection measurement system of claim 1 wherein said test point interrogator includes one of an external power source or a rechargeable battery pack, thereby enabling mobile operation of said test point interrogator, and further includes memory circuitry for recording a second plurality of cathodic voltage values.

10. The cathodic protection measurement system of claim 9 wherein said second plurality of cathodic voltage values includes cathodic voltage values received from at least one test point monitor.

11. The cathodic protection measurement system of claim 1 wherein said test point monitor is located in an above ground location.

12. The cathodic protection measurement system of claim 1 wherein said test point monitor is located in a below ground location, and further wherein said test point monitor is coupled to a cathodic voltage source and a reference cell.

13. A method of measuring cathodic protection voltage comprising:

locating a test point monitor using a GPS system;

operating said test point monitor in a selected activity state;

measuring a cathodic voltage value with said test point monitor at a first predetermined time interval initiated by said test point monitor;

communicating an interrogation signal from a test point interrogator to said test point monitor;

receiving said interrogation signal at said test point monitor;

communicating said cathodic voltage signal from said test point monitor to said test point interrogator;

receiving said cathodic voltage signal at said test point interrogator; and communicating said cathodic voltage signal from said test point interrogator to a computer system.

14. The method of claim 13 wherein said step of communicating said cathodic voltage signal from said test point interrogator to a central computer system includes wirelessly transmitting said cathodic voltage signal from said test point interrogator to said central computer system.

15. The method of claim 13 further comprising the step of automatically interrogating said proximal test point monitor.

16. The method of claim 13 wherein the step of operating said test point monitor in said selected activity state includes a sleep state and an active state.

17. The method of claim 13 wherein the step of communicating said interrogation signal from said test point interrogator to said test point monitor includes communicating said interrogation signal at a second predetermined time interval, and further wherein said first time interval and said second time interval are distinct.

18. The method of claim 13 further comprising the step of coupling said test point monitor to a cathodic voltage source and to reference cell.

19. The method of claim 18 further comprising the step of locating said test point monitor in an above ground location.

20. The method of claim 18 further comprising the step of locating said test point monitor in a below ground location.

21. A method of measuring cathodic protection voltage comprising:

operating a test point monitor in a selected activity state;

measuring a cathodic voltage value with said test point monitor at a first predetermined time interval;

communicating an interrogation signal from a test point interrogator to said test point monitor;

receiving said interrogation signal at said test point monitor;

communicating said cathodic voltage signal from said test point monitor to said test point interrogator;

receiving said cathodic voltage signal at said test point interrogator; and locating a proximal test point manner using a GPS system integral to said test point interrogator.

22. The method of claim 21 further comprising the step of communicating said cathodic voltage signal from said test point interrogator to a central computer system.

23. The method of claim 21 wherein said step of communicating said cathodic voltage signal from said test point interrogator to a central computer system includes wirelessly transmitting said cathodic voltage signal from said test point interrogator to said central computer system.

24. The method of claim 21 further comprising the step of automatically interrogating said proximal test point monitor.

25. The method of claim 21 wherein the step of operating said test point monitor in said selected activity state includes a sleep state and an active state.

26. The method of claim 21 wherein the step of communicating said interrogation signal from said test point interrogator to said test point monitor includes communicating said interrogation signal at a second predetermined time interval, and further wherein said first time interval and said second time interval are distinct.

27. The method of claim 21 further comprising the step of coupling said test point monitor to a cathodic voltage source and to reference cell.

28. The method of claim 27 further comprising the step of locating said test point monitor in an above ground location.

29. The method of claim 27 further comprising the step of locating said test point monitor in a below ground location.

* * * * *